US010174544B2

(12) United States Patent
Kellum

(10) Patent No.: US 10,174,544 B2
(45) Date of Patent: Jan. 8, 2019

(54) CORNER KEY FOR EXTRUDED WINDOWS AND DOORS

(71) Applicant: Amesbury Group, Inc., Amesbury, MA (US)

(72) Inventor: Wilbur J. Kellum, Garretson, SD (US)

(73) Assignee: Amesbury Group, Inc., Amesbury, MA (US)

( * ) Notice: Subject to any disclaimer, the term of this patent is extended or adjusted under 35 U.S.C. 154(b) by 0 days.

(21) Appl. No.: 15/613,866

(22) Filed: Jun. 5, 2017

(65) Prior Publication Data

US 2018/0347262 A1 Dec. 6, 2018

(51) Int. Cl.
*E06B 3/964* (2006.01)

(52) U.S. Cl.
CPC ..... *E06B 3/9645* (2013.01); *E06B 3/9644* (2013.01); *E06B 3/9646* (2013.01); *E05F 2700/00* (2013.01)

(58) Field of Classification Search
CPC .... E06B 3/9645; E06B 3/9644; E06B 3/9646; E05F 2700/00; Y10T 403/555; Y10T 403/4602; Y10T 403/725; A47G 1/10
USPC ..... 403/295, 402, 298; 52/656.9, 656.5
See application file for complete search history.

(56) References Cited

U.S. PATENT DOCUMENTS 3,294,429 A * 12/1966 Halip ..... A47G 1/10 40/782
3,485,519 A * 12/1969 Chiu ..... F16B 12/40 403/172
3,627,359 A * 12/1971 Paul ..... A47G 1/10 160/381
3,709,533 A * 1/1973 Walters ..... E05D 15/0647 160/381
3,829,226 A * 8/1974 Kreusel ..... E06B 3/9681 403/295
3,866,380 A * 2/1975 Benson ..... E06B 3/667 403/205
4,136,470 A * 1/1979 Barz ..... A47G 1/10 40/782
4,380,110 A * 4/1983 Harig ..... A47G 1/10 228/142
4,516,341 A * 5/1985 Jenkins ..... A47G 1/10 40/785
4,531,315 A * 7/1985 Sobel ..... A47G 1/10 40/758
4,974,352 A * 12/1990 Shwu-Jen ..... A47G 1/10 40/783
5,040,456 A * 8/1991 Hayes ..... B41F 15/36 101/127.1
5,144,780 A * 9/1992 Gieling ..... E04B 1/5831 135/114

(Continued)

FOREIGN PATENT DOCUMENTS

JP 06240958 A * 8/1994 ..... E06B 3/9612

OTHER PUBLICATIONS

Strybuc replacement corner keys, pp. 250-253: located online at: http://www.strybuc.com/public/Catalogs/Strybuc/Strybuc-Window-and-Door-Hardware-Catalog-2016/#?page=250, 2016.

*Primary Examiner* — Brent W Herring

(57) ABSTRACT

A corner key includes a heel and at least one leg extending along an axis from the heel. The at least one leg includes a retention element and a lifting cam such that upon insertion into a frame member the lifting cam induces a bending stress in the retention element.

16 Claims, 18 Drawing Sheets

(56) References Cited

U.S. PATENT DOCUMENTS

| | | | | |
|---|---|---|---|---|
| 6,413,004 | B1 * | 7/2002 | Lin | B25B 7/02 403/171 |
| 7,806,620 | B1 * | 10/2010 | Brochez | E06B 3/9765 403/295 |
| 8,250,819 | B2 * | 8/2012 | Subra | E06B 3/9616 52/172 |
| 8,763,342 | B2 | 7/2014 | Tseng | |
| 9,869,122 | B2 * | 1/2018 | Isaacs | E06B 1/12 |
| 2008/0056817 | A1 * | 3/2008 | Fasanella | F16L 23/14 403/401 |
| 2010/0192508 | A1 * | 8/2010 | Subra | E06B 3/9616 52/656.9 |
| 2017/0218680 | A1 * | 8/2017 | Isaacs | E06B 1/12 |

* cited by examiner

CORNER KEY FOR EXTRUDED WINDOWS AND DOORS

INTRODUCTION

Window and door frames may be held together at a corner joint by an "L"-shaped piece of hardware known as a corner key. Corner keys enable two side members of the frame to be secured together without the hardware being visible. These corner keys are press fit into the frame members to induce a retention force therein and restrict the corner key from being pulled out, which can cause the frame members to separate. However, some known corner keys do not provide a consistent retention force to restrain movement of the frame members. Additionally, some known corner keys create a gap between two frame members because the corner keys become skewed within the frame members.

SUMMARY

In one aspect, the technology relates to a corner key including: a heel; and at least one leg extending along an axis from the heel, the at least one leg including a retention element and a lifting cam, wherein upon insertion into a frame member the lifting cam induces a bending stress in the retention element.

In an example, the at least one leg further includes a first surface and a second surface, and wherein the retention element is disposed on the first surface and the lifting cam is disposed on the second surface. In another example, the first surface is opposite the second surface. In yet another example, the retention element includes a cantilevered arm defined in the at least one leg and extending towards the heel along the axis. In still another example, the cantilevered arm includes a free end, and wherein the cantilevered arm tapers towards the free end. In an example, the cantilevered arm includes a free end and a barb disposed on the free end.

In another example, the bending stress is configured to apply a retention force from the barb to the frame member. In yet another example, the retention element and the lifting cam are offset along the axis. In still another example, the at least one leg further includes a tip, the tip including a tapered nose. In an example, the tapered nose is substantially conically-shaped. In another example, the at least one leg is a first leg and the corner key further includes a second leg extending along a second axis from the heel, the second leg including a second retention element and a second lifting cam, wherein upon insertion into a second frame member the second lifting cam induces a second bending stress in the second retention element.

In yet another example, the first leg and the second leg are spaced approximately 90° apart. In still another example, the corner key further includes an inner surface and an opposite outer surface, and wherein an undercut corner is defined in the inner surface at the intersection of the first leg and the second leg. In an example, the heel includes a corner extension opposite the undercut corner. In another example, the first leg is axially longer than the second leg. In yet another example, the bending stresses are configured to apply at least 35 pounds of retention force from the corner key to the first and second frame members. In still another example, the bending stresses are configured to apply at least 50 pounds of retention force from the corner key to the first and second frame members.

In another example, the technology relates to a corner key including: a heel; a first leg extending along a first axis from the heel, wherein the first leg includes a first inner surface defining a first tapered cantilevered arm and an opposite first outer surface defining a first lifting cam; and a second leg extending along a second axis from the heel, wherein the second leg includes a second inner surface defining a second tapered cantilevered arm and an opposite second outer surface defining a second lifting cam.

In another example, the technology relates to a method of installing a corner key into a frame member, the method including: aligning a leg of the corner key with a channel of the frame member via a tapered nose of the leg; sliding the leg into the channel such that a retention element defined in the leg is fully received within the channel; and after receipt of the retention element within the channel, actuating the retention element via a lifting cam such that a bending stress is induced in the retention element to secure the leg to the frame member. In an example, the frame member is a first frame member and the leg is a first leg, and the method further includes: over-inserting the first leg into the first channel such that a portion of the first frame member is received in an undercut corner; and sliding a second frame member onto a second leg of the corner key, wherein the second frame member engages a corner extension of the corner key to induce a tension load on the retention element and align the corner key within the first and second frame members.

DRAWINGS

There are shown in the drawings, embodiments which are presently preferred, it being understood, however, that the technology is not limited to the precise arrangements and instrumentalities shown.

DETAILED DESCRIPTION

Figure 1:
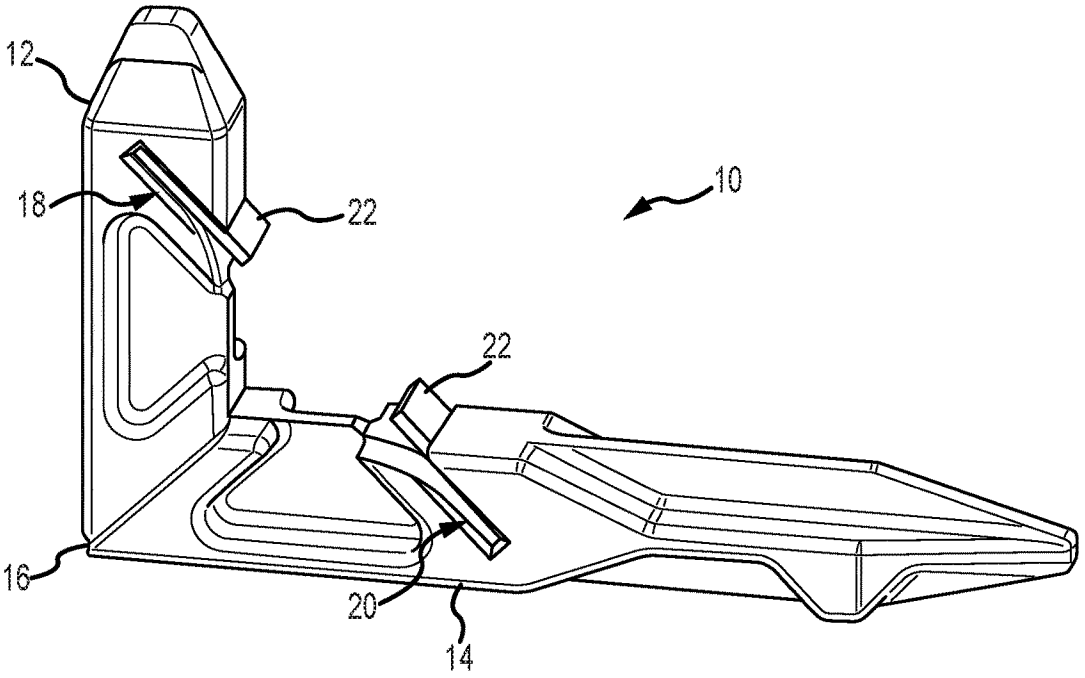
FIG. 1 PRIOR ART
FIG. 1 is a perspective view of a prior art corner key.

FIG. 1 is a perspective view of a prior art corner key 10. The corner key 10 is a die cast "L"-shape with a short leg 12 and a long leg 14 connected at a heel 16. Each leg 12, 14 defines a slot 18, 20, respectively, that receives a steel tab 22 which is inserted therein. The steel tabs 22 are angled so as to act as retention devices when installed at a corner joint of a window or door frame. As the slots 18, 20 are relatively thin, the die cast molds used for manufacturing the corner key 10 are fragile and are known to break. The manufacturing process for the corner key 10 requires the separate steel tabs 22 to be inserted either manually, which is a laborious and time consuming process, or automatically, requiring a machine that must be frequently maintained. Additionally, the steel tabs 22 may undesirably shift out of position or fall out prior to use of the corner key. As such, the corner key 10 provides inconsistent retention forces at the corner assembly with push-in forces (e.g., the force required for corner assembly) ranging from 17 pounds to 70 pounds and pull-out forces (e.g., the force required to pull the corner assembly apart) ranging from 27 pounds to 75 pounds.

Broadly speaking, this disclosure describes configurations that improve the performance of a corner key. Specifically, examples, configurations, and arrangements of a corner key are shown and described in more detail below with reference to the following figures. The corner keys for extruded windows and doors described herein increases efficiency of installing the corner key as well as manufacturing the corner key. The corner key includes a retention element that is automatically actuated after insertion into the frame member, thereby reducing wear to the edge of the frame member. Additionally, the retention element uniformly distributes the bending stress along the length of an arm, inducing consistent retention forces on the frame member to provide a more secure connection. A heel of the corner key facilitates pre-loading tension into the corner key and aligning the corner key within the frame members thereby forming a more snug connection and reducing undesirable pull-out. Furthermore, the corner keys may be manufactured by a die-cast method that is automated thereby reducing manufacturing costs.

Figure 2A:
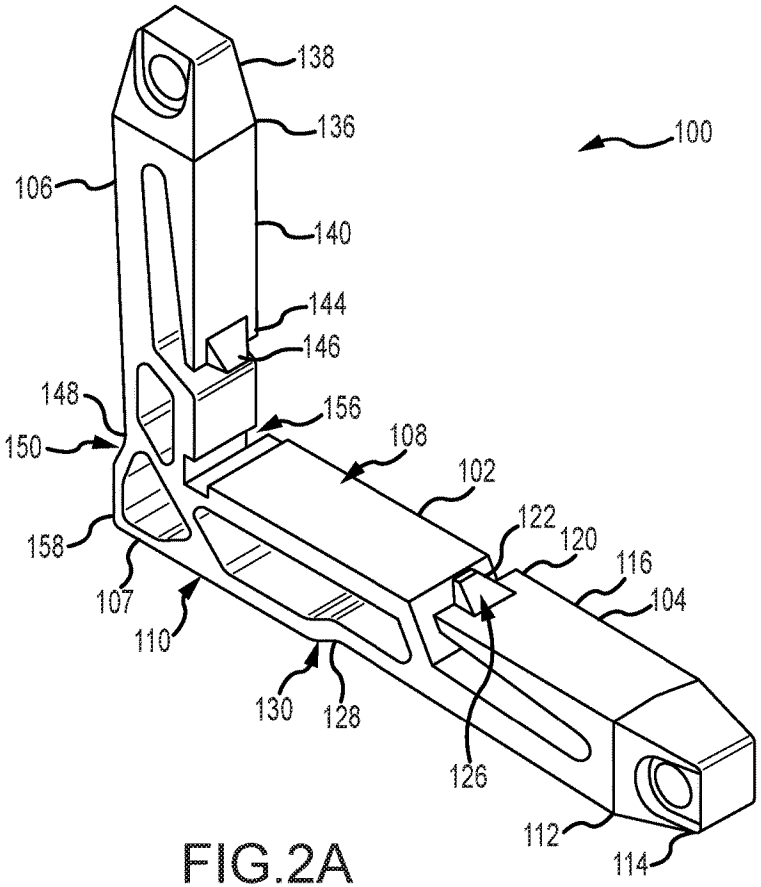
FIGS. 2A and 2B are perspective views of an example of a corner key.
Figure 2B:
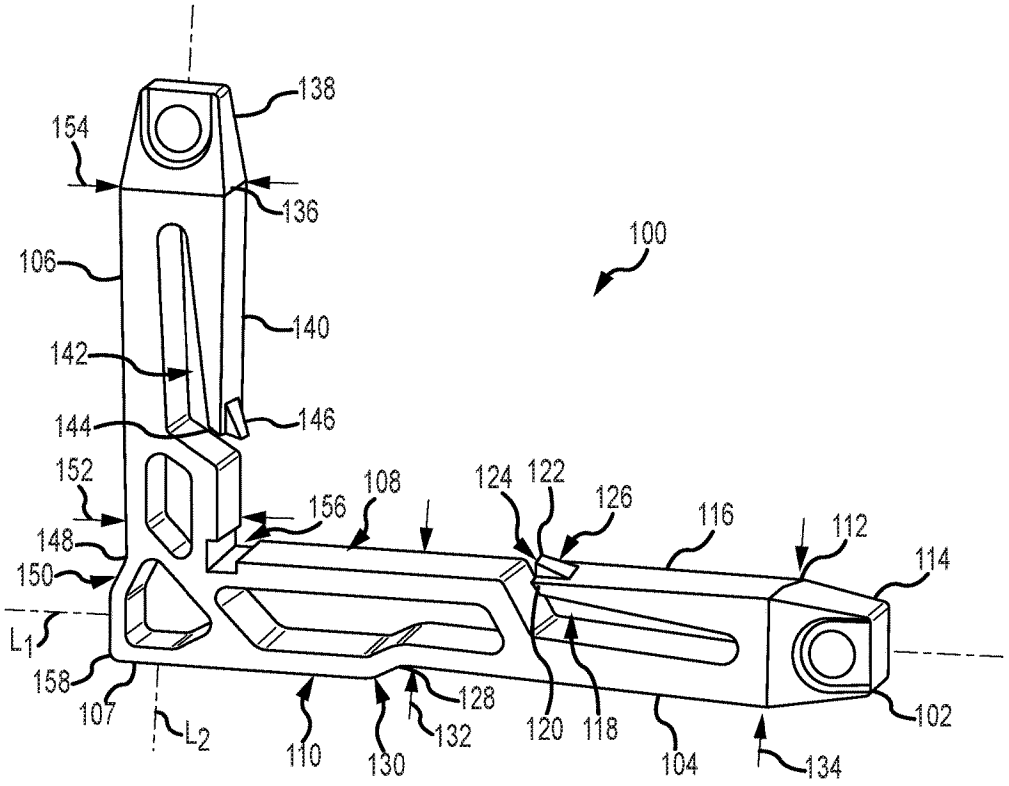

FIGS. 2A and 2B are perspective views of an example of a corner key 100 and are described concurrently. In the example, the corner key 100 includes an "L"-shaped body 102 that may be formed from a one-piece zinc die casting method, such that the body 102 is unitary. The body 102 includes a first leg 104 spaced approximately 90° from a second leg 106 and intersecting at a heel 107. The body 102 also includes an inner surface 108 and an opposite outer surface 110. As described herein, inner and outer refer to the orientation of the corner key 100 when being assembled in a frame of a window or door.

The first leg 104 extends along a longitudinal axis $L_1$ and includes a tip 112 defining a tapered nose 114. The tapered nose 114 increases ease of assembly and enables the leg 104 to be received more easily within the frame member. The leg 104 includes a retention element formed from an arm 116 extending along the longitudinal axis $L_1$ opposite the nose 114. The arm 116 is cantilevered from the tip 112 and extends over a recess 118 defined in the body 102. The arm 116 is resilient and flexible with a tapered profile such that bending stresses are uniformly distrusted along the length of the cantilever as described further below. Because the arm 116 is tapered, a free end 120 may deflect more than other sections of arm 116. At the free end 120 of the arm 116, a barb 122 extends outward from the inner surface 108. In the example, the barb 122 has a steep inclined surface 124 adjacent the free end 120 and an opposite shallow inclined surface 126. The shallow inclined surface 126 enables the arm 116 to be slidably received within the frame member, while the steep inclined surface 124 provides for an engagement surface when the barb 122 engages with the frame member to secure the corner key 100 within the frame member. The leg 104 also includes a lifting cam 128 defined on the outer surface 110. The lifting cam 128 is offset along the longitudinal axis $L_1$ from the arm 116 and includes an oblique surface 130 such that a depth 132 of the leg 104 at the oblique surface 130 is less than a depth 134 of the tip 112 of the leg 104. The lifting cam 128 is discussed further below.

The second leg 106 extends along a longitudinal axis $L_2$ and includes a tip 136 defining a tapered nose 138. The tapered nose 138 increases ease of assembly and enables the leg 106 to be received more easily within the frame member. The leg 106 includes a retention element formed from an arm 140 extending along the longitudinal axis $L_2$ opposite the nose 138. The arm 140 is cantilevered from the tip 136 and extends over a recess 142 defined in the body 102. The arm 140 is resilient and flexible with a tapered profile such that bending stresses are uniformly distrusted along the length of the cantilever as described further below. Because the arm 140 is tapered, a free end 144 may deflect more than other sections of arm 140. At the free end 144 of the arm 140, a barb 146 extends outward from the inner surface 108 with two inclined surfaces as described above. The leg 106 also includes a lifting cam 148 defined on the outer surface 110. The lifting cam 148 is offset along the longitudinal axis $L_2$ from the arm 140 and includes an oblique surface 150 such that a depth 152 of the leg 106 at the oblique surface 150 is less than a depth 154 of the tip 136 of the leg 106.

In the example, the first leg 104 is longer than the second leg 106 such that additional window or door hardware may be located within the frame member. In alternative examples, the first leg 104 length may be approximately equal to the second leg 106 length.

At the intersection of the first leg 104 and the second leg 106, the heel 107 is defined and includes an undercut corner 156 defined in the inner surface 108. The undercut corner 156 reduces the depth of the heel 107 to enable an over-insertion of the corner key 100 within the frame member. At the outer surface 110 of the heel 107, a corner extension 158 is defined. The corner extension 158 increases the depth of the heel 107 along both the first and second legs 104, 106 to align the corner key 100 within the frame member to correct the over-insertion provided by the undercut corner 156 and to induce a tension force within the corner key 100 as described further below.

Figure 3A:
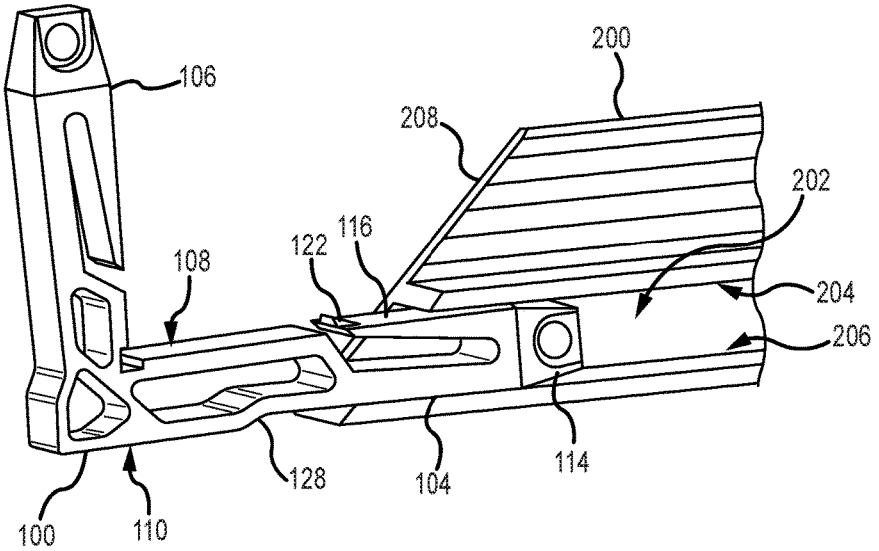
FIGS. 3A-3C is a series of cross-sectional perspective views of the corner key shown in FIGS. 2A and 2B being inserted into a frame member.
Figure 3B:
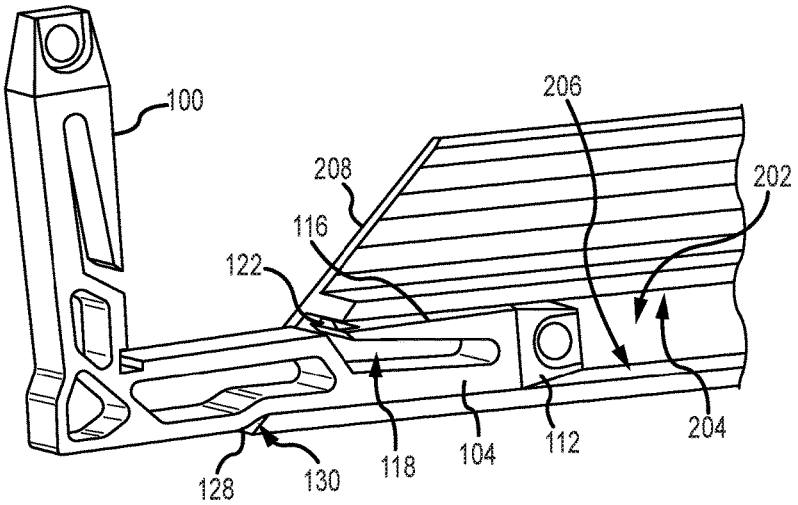
Figure 3C:
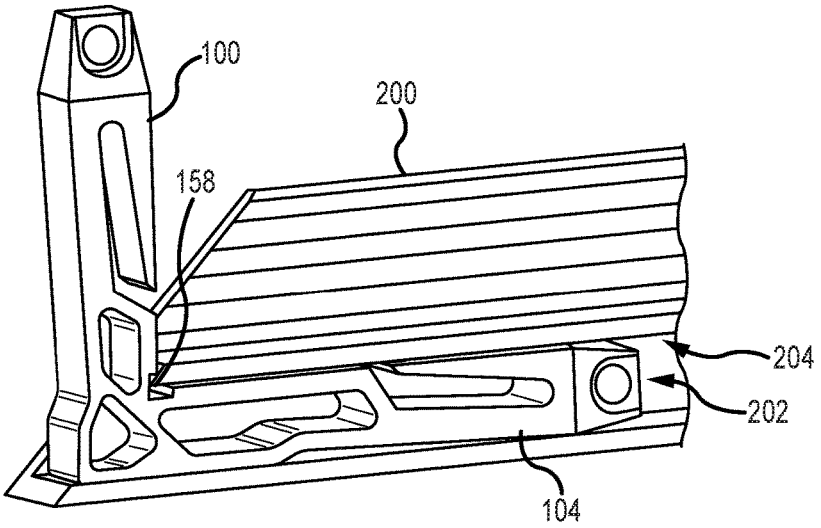

FIGS. 3A-3C is a series of cross-sectional perspective views of the corner key 100 being inserted into a frame member 200. Starting with FIG. 3A, the first leg 104 of the corner key 100 is partially inserted into a channel 202 of a frame member 200. The channel 202 includes an inner surface 204 and an outer surface 206. The tapered nose 114 facilitates aligning the first leg 104 within the channel 202 so that it may be slidably received therein. The inner surface 108 of the corner key 100 slides against the inner surface 204 of the channel 202 and the outer surface 110 of the corner key 100 slides against the outer surface 206 of the channel 202. In the example, the frame member 200 is illustrated in cross-section and can be either part of a window frame or a door frame with a 45° edge 208. The corner key 100 is configured to couple the frame member 200 to another frame member (not shown) so as to secure the two frame members together without the corner key 100 being visible.

Referring now to FIG. 3B, the leg 104 of the corner key 100 is further inserted into the channel 202 such that the outer surface 206 of the channel 202 begins to engage the lifting cam 128. The barb 122 and the oblique surface 130 are spaced such that the barb 122 clears the edge 208 of the frame member 200 before the outer surface 206 engages with the lifting cam 128. Before the lifting cam 128 is engaged, the arm 116 and the barb 122 are slidably inserted into the channel 202 and there are no bending stresses induced on the arm 116 because the depth of the leg 104 progressively decreases from the tip 112 to the oblique surface 130 as described above. This reduces wear on the edge 208, reduces excessive abrasion to the barb 122, and also reduces the amount of insertion force necessary to initially slide the leg 104 within the channel 202. Once the barb 122 clears the edge 208 and the outer surface 206 of the channel 202 engages the oblique surface 130, bending stresses are induced on the arm 116 by the lifting of the leg 104 relative to the inner surface 204 of the channel 202. More specifically, the arm 116 is depressed into the recess 118 as the outer surface 206 of the channel 202 passes along the oblique surface 130 and lifts the leg 104 within the channel 202. The bending stress causes the barb 122 to engage with the inner surface 204 with a retention force to secure the corner key 100 within the channel 202.

Turning now to FIG. 3C, the leg 104 of the corner key 100 is fully inserted into the channel 202. Once the leg 104 is within the channel 202, the barb 122 is engaged with the inner surface of the channel 202 with the retention force to secure the corner key 100 to the frame member 200. The undercut corner 156 enables the leg 104 to be over-inserted into the channel 202 and apply a preloaded tension force on the corner key 100 as described further below.

Figure 3D:
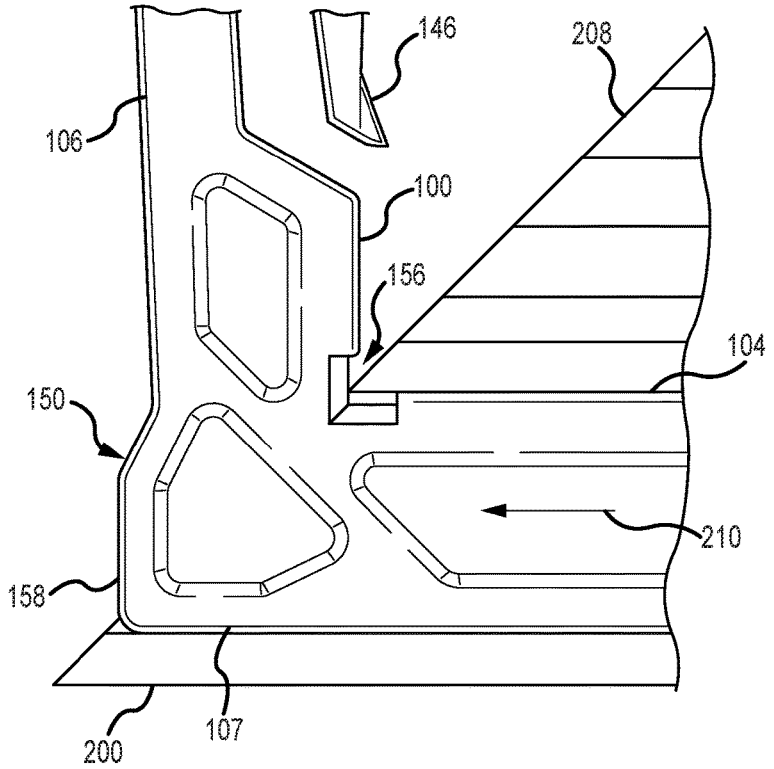
FIG. 3D is an enlarged cross-sectional side view of the corner key shown in FIGS. 2A and 2B inserted into the frame member.

FIG. 3D is an enlarged cross-sectional side view of the corner key 100 inserted into the frame member 200. The corner key 100 is over-inserted into the channel 202 of the frame member 200 such that the edge 208 extends into the undercut corner 156 and to the second leg 106. Additionally, the corner extension 158 of the heel 107 is at least partially received within the channel 202. When a second frame member (not shown) is inserted on to the second leg 106, the oblique surface 150 lifts the leg 106 relative to the channel of the second frame member to engage the barb 146. This lifting of the second leg 106 also generates a pullback force 210 on the first leg 104 so as to place the barb engagement in tension. This pullback force 210 also reduces the over insertion of the leg 104 such that the edge 208 retracts from the undercut corner 156. Additionally, the pullback force 210 moves the corner extension 158 out of the over-insertion within the channel 202 and aligns the heel 107 within each frame member channel and match the edges of the frame members together for a sung clean fit without any gaps therebetween.

Figure 4B:
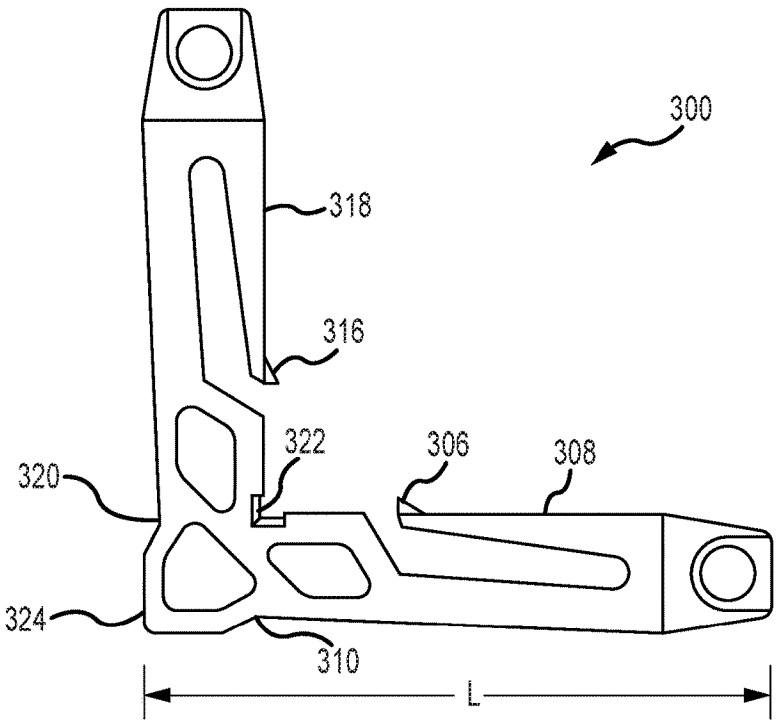
FIG. 4B is a side view of the corner key shown in FIG. 4A.
Figure 4A:
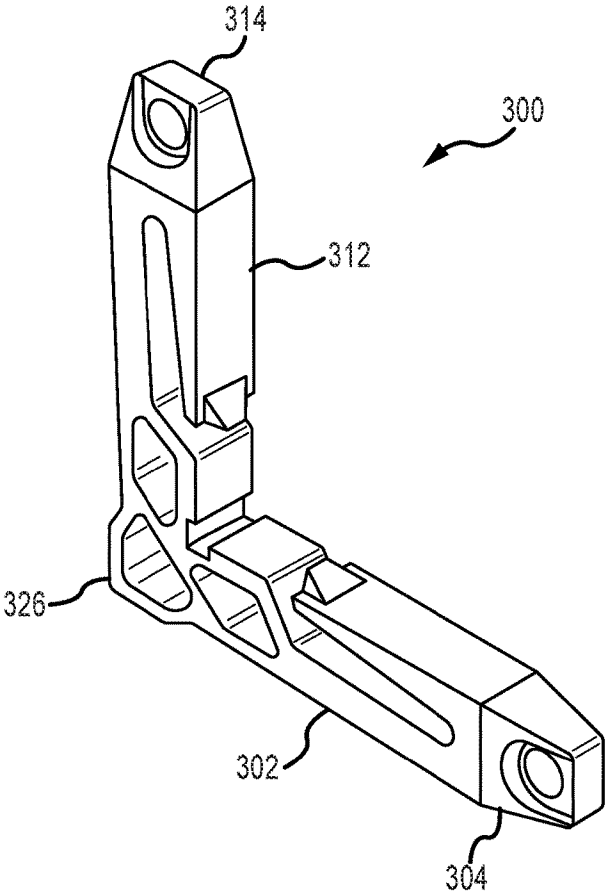
FIG. 4A is a perspective view of another example of a corner key.

FIG. 4A is a perspective view of another example of a corner key 300. FIG. 4B is a side view of the corner key 300. Referring concurrently to FIGS. 4A and 4B, the corner key 300 includes a first leg 302 having a tapered nose 304, a barb 306 extending from a resilient flexible arm 308, and a lifting cam 310, and a second leg 312 having a tapered nose 314, a barb 316 extending from a resilient flexible arm 318, and a lifting cam 320 as described in the example above. Additionally, the corner key 300 includes an undercut corner 322 and a corner extension 324 positioned at a heel 326 as describe in the example above. However, in this example, the length L of the first leg 302 is approximately equal to the second leg 312.

Figure 4C:
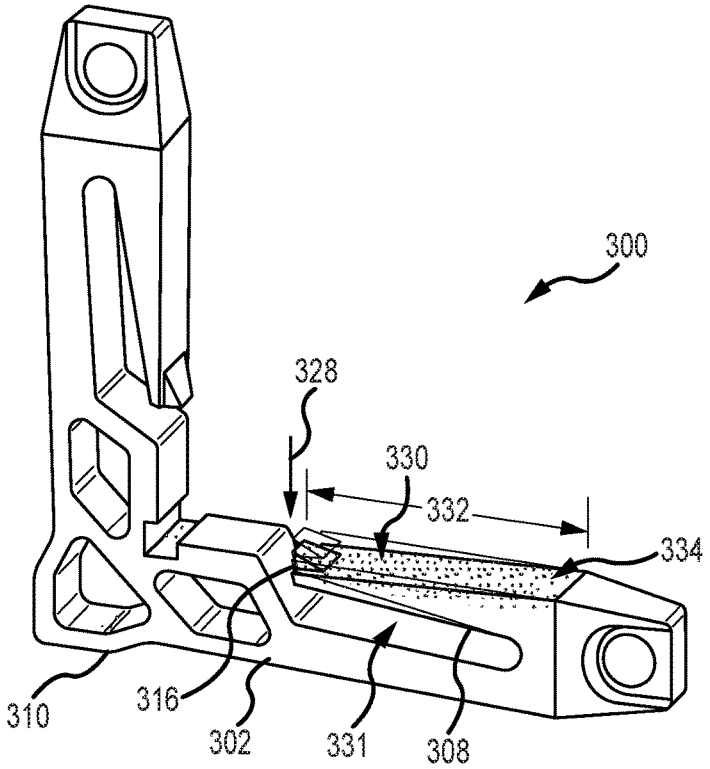
FIG. 4C is a stress distribution diagram of the corner key shown in FIG. 4A.

FIG. 4C is a stress distribution diagram of the corner key 300. When a load 328 is applied to the barb 316, for example, when the leg 302 is inserted into the frame member (not shown) and the arm 308 is depressed into a recess 331, the bending stresses 330 induced on the arm 308 are uniformly distributed along the length 332 of the arm 308. The tapered shape of the arm 308 facilitates that the bending stresses 330 occur along the inner surface 334 of the arm 308 and be approximately consistent along the length 332, even through the free end of the arm 308 deflects more than a middle or end section of the arm 308. This stress distribution on the arm 308 reduces fatigue of the corner key 300 and generates a uniform resultant force (e.g., the retaining force) so as to maintain engagement of the barb 316 within the frame member. Additionally, the bending stresses 330 induced on the arm 308 are not transferred to the rest of the corner key 300. In this example, the corner key 300 provides approximately 35 pounds of retaining force (the force required to pull the corner assembly apart).

Figure 4D:
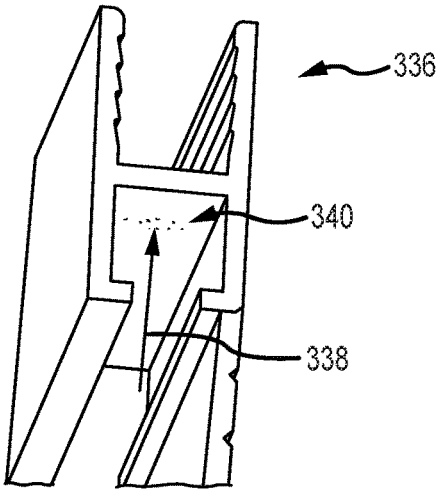
FIG. 4D is a deformation diagram of a frame member.

FIG. 4D is a deformation diagram of a frame member 336. As described above, the bending stresses induced in the arm 308 results in the barb 316 engaging with the frame member 336 with a retaining force 338. The size and shape of the barb 316, and the force 338 upon which it acts, results in the deformation of the frame member 336 about an engagement area 340. In the example, the engagement area 340 has a deformation that is relatively constant throughout the area thereby providing for a more secure engagement of the corner key 300.

Figure 5:
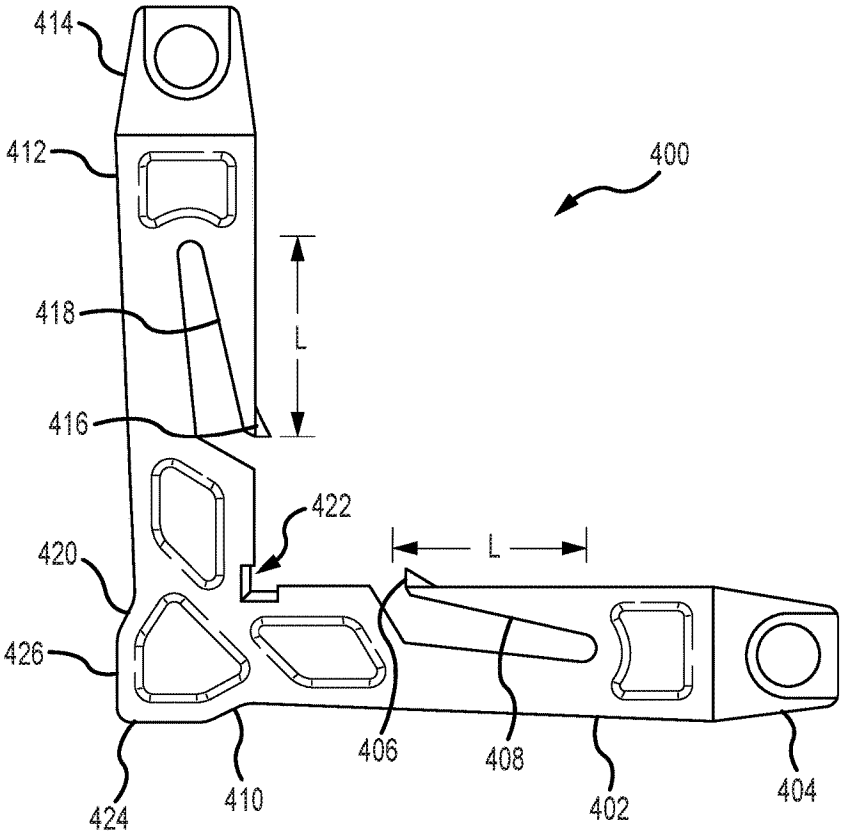
FIG. 5 is a side view of another example of a corner key.

FIG. 5 is a side view of another example of a corner key 400. The corner key 400 includes a first leg 402 having a tapered nose 404, a barb 406 extending from a resilient flexible arm 408, and a lifting cam 410, and a second leg 412 having a tapered nose 414, a barb 416 extending from a resilient flexible arm 418, and a lifting cam 420 as described in the examples above. Additionally, the corner key 400 includes an undercut corner 422 and a corner extension 424 positioned at a heel 426 as described in the examples above. However, in this example, the length L of the cantilevered arms 408, 418 are shorter than the previous examples to increase the retaining force of the corner key 400 with respect to the frame member. By shortening the arms 408, 418 the same amount of deflection that occurs from inserting the corner key 400 into the window frame induces a greater amount of bending stresses therein and an increased retaining force that engage the barbs 406, 416 with the window frame. For example, the corner key 400 provides approximately 50 pounds of retaining force. In alternative examples, each cantilevered arm 408, 418 may have different lengths so as to vary the retaining force for each leg as required or desired.

Figure 6:
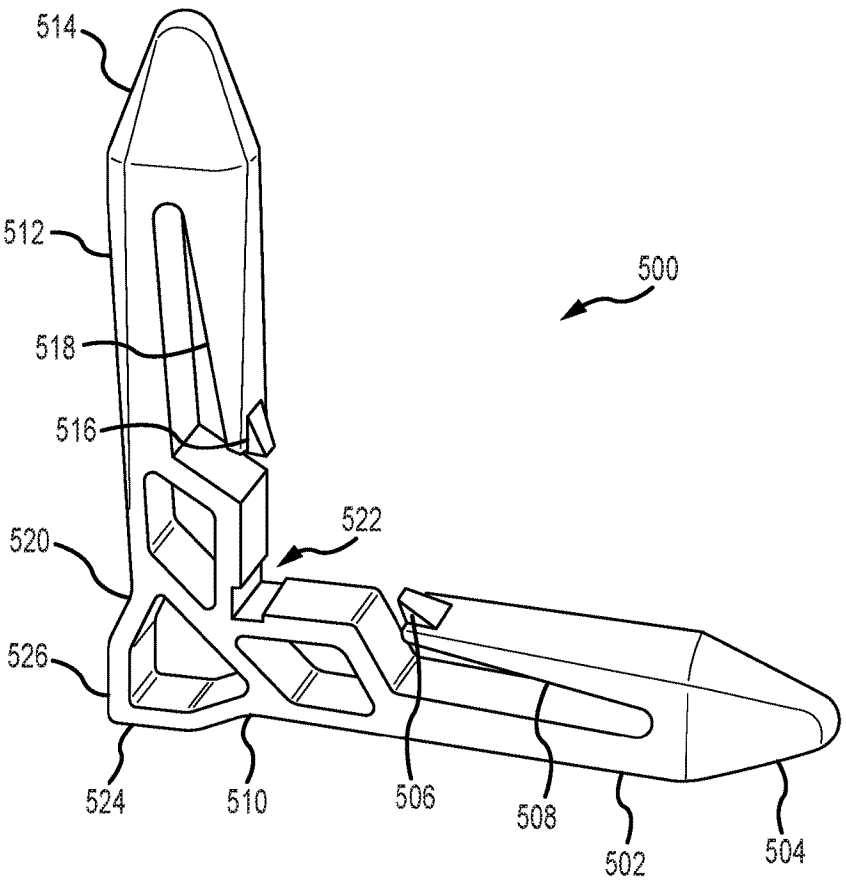
FIG. 6 is a perspective view of another example of a corner key.

FIG. 6 is a perspective view of another example of a corner key 500. The corner key 500 includes a first leg 502 having a tapered nose 504, a barb 506 extending from a resilient flexible arm 508, and a lifting cam 510, and a second leg 512 having a tapered nose 514, a barb 516 extending from a resilient flexible arm 518, and a lifting cam 520 as described in the examples above. Additionally, the corner key 500 includes an undercut corner 522 and a corner extension 524 positioned at a heel 526 as described in the examples above. However, in this example, the tapered nose 504, 514 is more elongated and having a substantially conically-shaped nose than the previous examples. As such, any misalignment of either leg 502, 512 when inserting into the frame member is easier to correct and enables easier window and door frame assembly.

Figure 7:
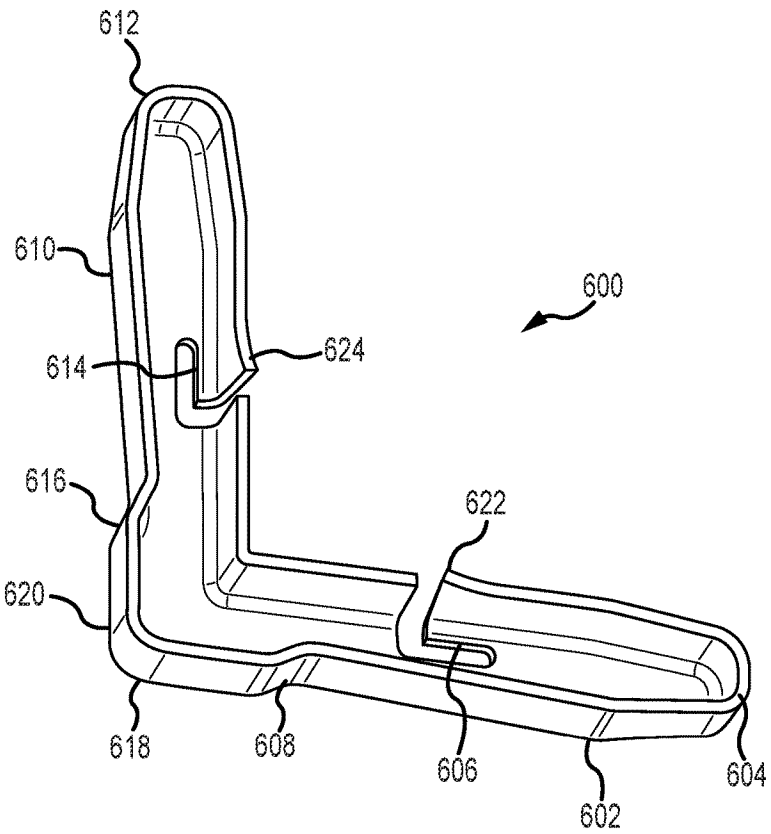
FIG. 7 is a perspective view of another example of a corner key.

FIG. 7 is a perspective view of another example of a corner key 600. The corner key 600 includes a first leg 602 having a tapered nose 604, a resilient flexible arm 606, and a lifting cam 608, and a second leg 610 having a tapered nose 612, a resilient flexible arm 614, and a lifting cam 616 as described in the examples above. Additionally, the corner key 600 includes a corner extension 618 positioned at a heel 620 as describe in the examples above. However, in this example, the arms 606, 614 include a raised corner 622, 624 instead of a barb as in the previous examples. The raised corners 622, 624 facilitate engaging the frame member as described above. By using the raised corners 622, 624 instead of the barbs, the corner key 600 may be manufactured by a stamping process.

Figure 8:
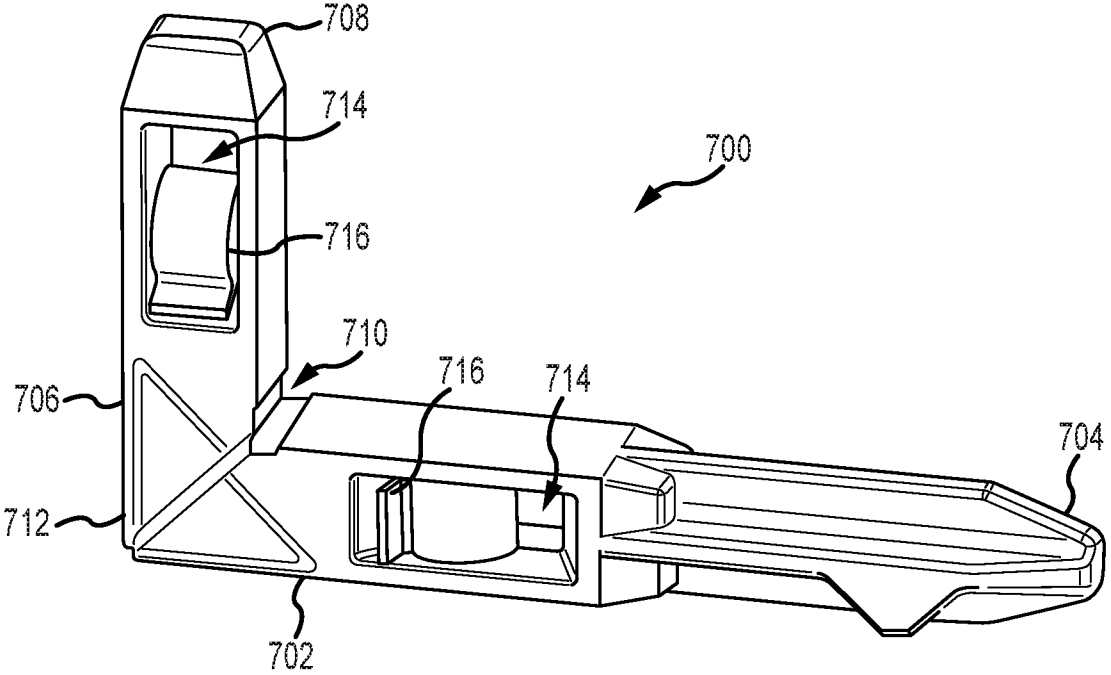
FIG. 8 is a perspective view of another example of a corner key.

FIG. 8 is a perspective view of another example of a corner key 700. The corner key 700 includes a first leg 702 having a tapered nose 704, and a second leg 706 having a tapered nose 708 as discussed above. Additionally, the corner key 700 includes an undercut corner 710 positioned at a heel 712 as described in the examples above. However, in this example, each leg 704, 706 defines an opening 714 that is configured to receive an omega-shaped spring clips 716. Each end of the clip 716 extends partially from the legs 704, 706 so as to engage the sides of the frame member channel and secure the corner key 700 therein. In the example, the legs 704, 706 are zinc die cast and the clips 716 are carbon steel.

Figure 9:
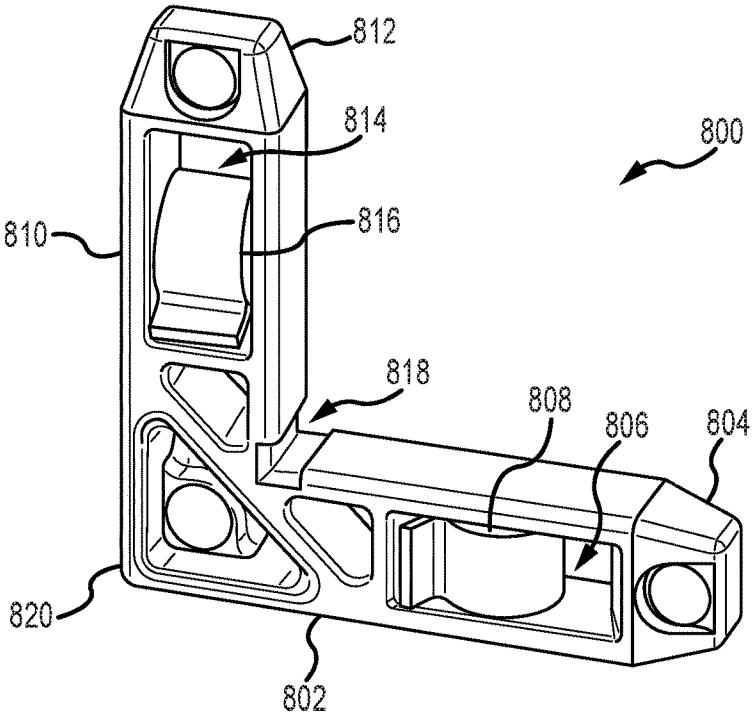
FIG. 9 is a perspective view of another example of a corner key.

FIG. 9 is a perspective view of another example of a corner key 800. The corner key 800 includes a first leg 802 having a tapered nose 804, an opening 806, and an omega-shaped spring clip 808, and a second leg 810 having a tapered nose 812, an opening 814, and an omega-shaped spring clip 816 as described above in FIG. 8. Additionally, the corner key 800 includes an undercut corner 818 positioned at a heel 820 as describe in the examples above. However, in this example, the length L of the first leg 802 is shorter than the previous example in FIG. 8 to accommodate hardware within the frame member.

Figure 10:
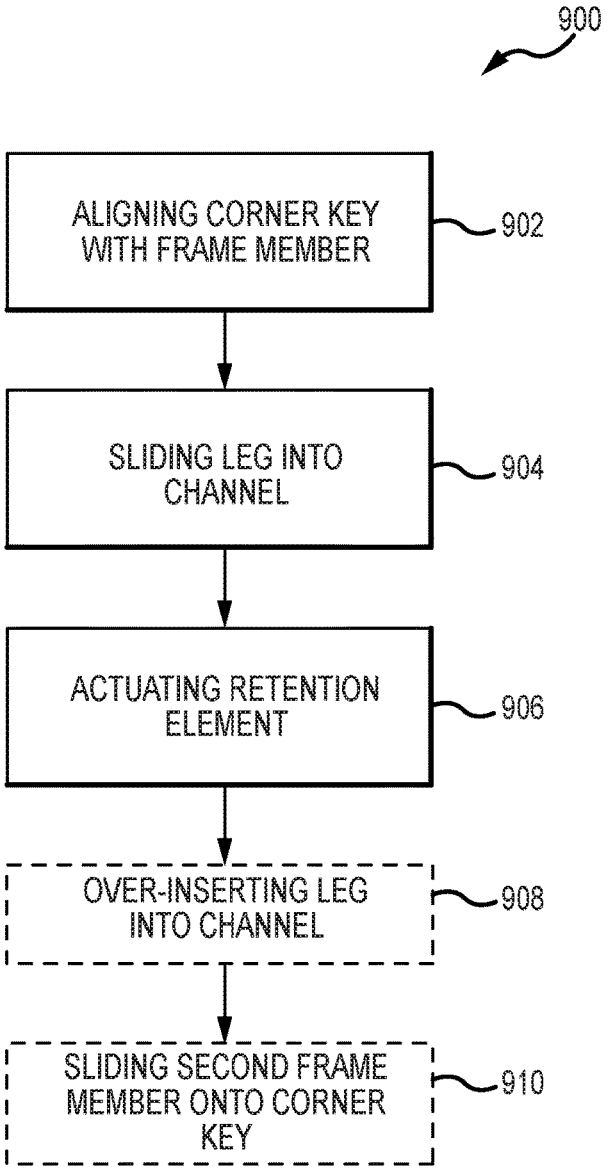
FIG. 10 is a flowchart illustrating a method of installing a corner key into a frame member.

FIG. 10 is a flowchart illustrating a method 900 of installing a corner key into a frame member. The method 900 includes aligning a leg of the corner key with a channel of the frame member via a tapered nose of the leg (operation 902), sliding the leg into the channel such that a retention element defined in the leg is fully received within the channel (operation 904), and after receipt of the retention element within the channel, actuating the retention element via a lifting cam such that a bending stress is induced in the retention element to secure the leg to the frame member (operation 906). In some examples, the frame member is a first frame member and the leg is a first leg and the method 900 further includes over-inserting the first leg into the first channel such that a portion of the first frame member is received in an undercut corner (operation 908), and sliding a second frame member onto a second leg of the corner key, wherein the second frame member engages a corner extension of the corner key to include a tension load on the retention element and align the corner key within the first and second frame members (operation 910).

Figure 11A:
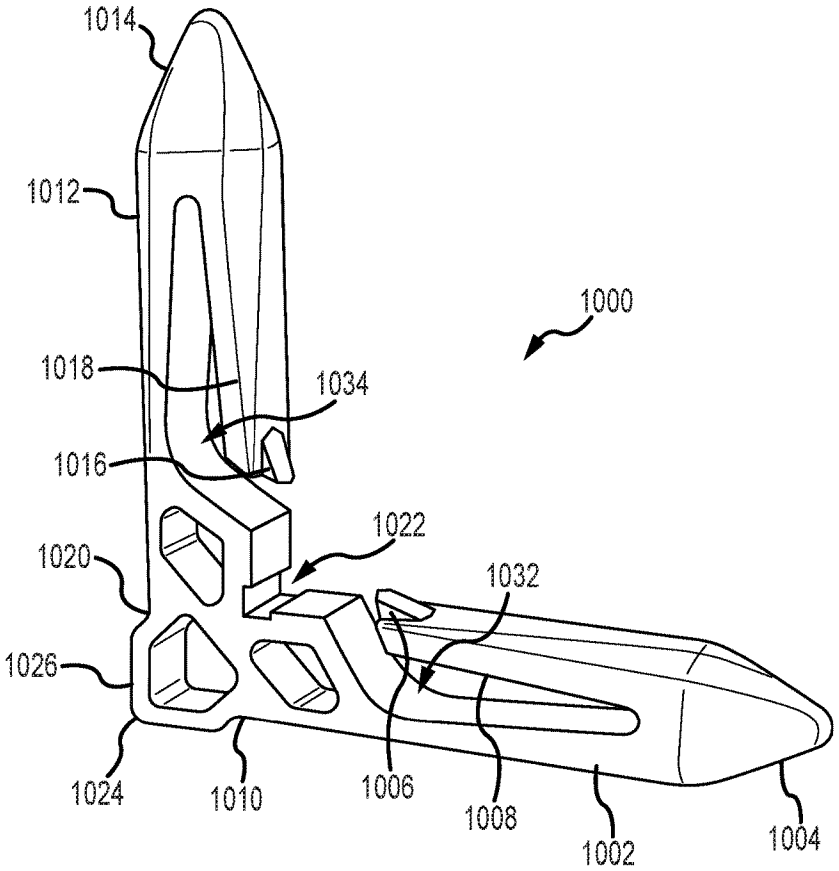
FIG. 11A is a perspective view of another example of a corner key.
Figure 11B:
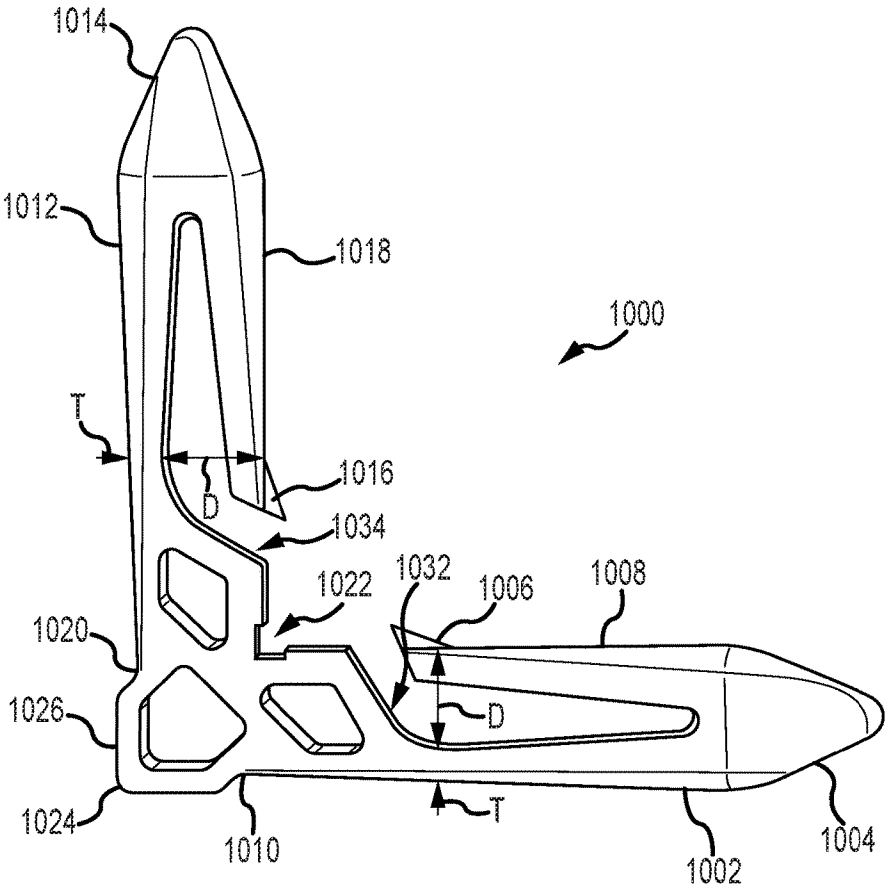
FIG. 11B is a side view of the corner key shown in FIG. 11A.

FIG. 11A is a perspective view of another example of a corner key 1000. FIG. 11B is a side view of the corner key 1000. Referring concurrently to FIGS. 11A and 11B, the corner key 1000 includes a first leg 1002 having a substantially conically-shaped nose 1004, a barb 1006 extending from a resilient flexible arm 1008, and a lifting cam 1010, and a second leg 1012 having a substantially conically-shaped nose 1014, a barb 1016 extending from a resilient flexible arm 1018, and a lifting cam 1020 as described in the examples above. Additionally, the corner key 1000 includes an undercut corner 1022 and a corner extension 1024 positioned at a heel 1026 as described in the examples above. However, in this example, each recess 1028, 1030 defined within each leg 1002, 1012 is larger than the previous examples and has a curved surface 1032, 1034. In this example, a depth D of the recess 1028, 1030 extends further within each leg 1002, 1012 such that a thickness T of the legs 1002, 1012 are reduced.

Figure 11C:
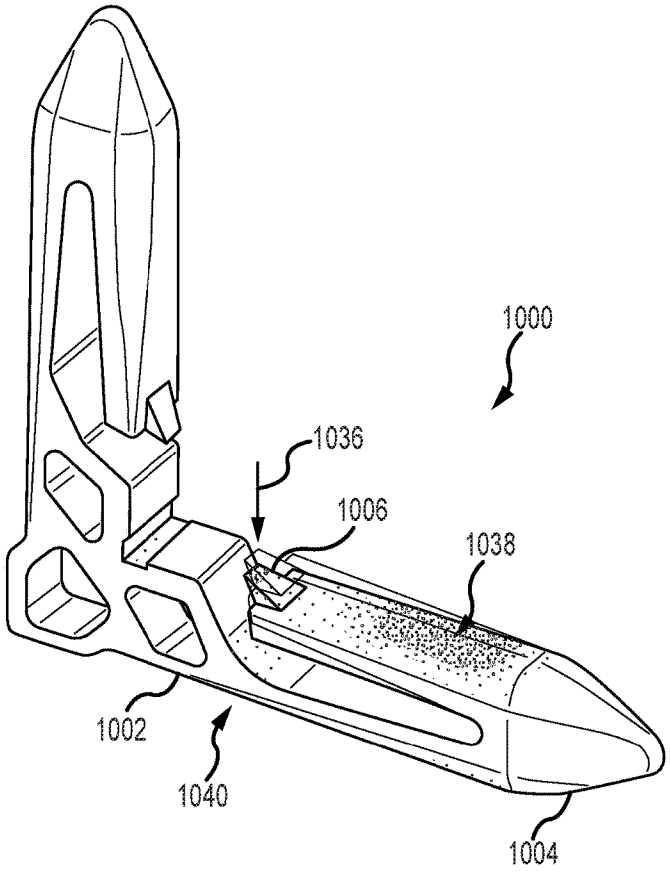
FIGS. 11C and 11D are stress distribution diagrams of the corner key shown in FIGS. 11A and 11B.
Figure 11D:
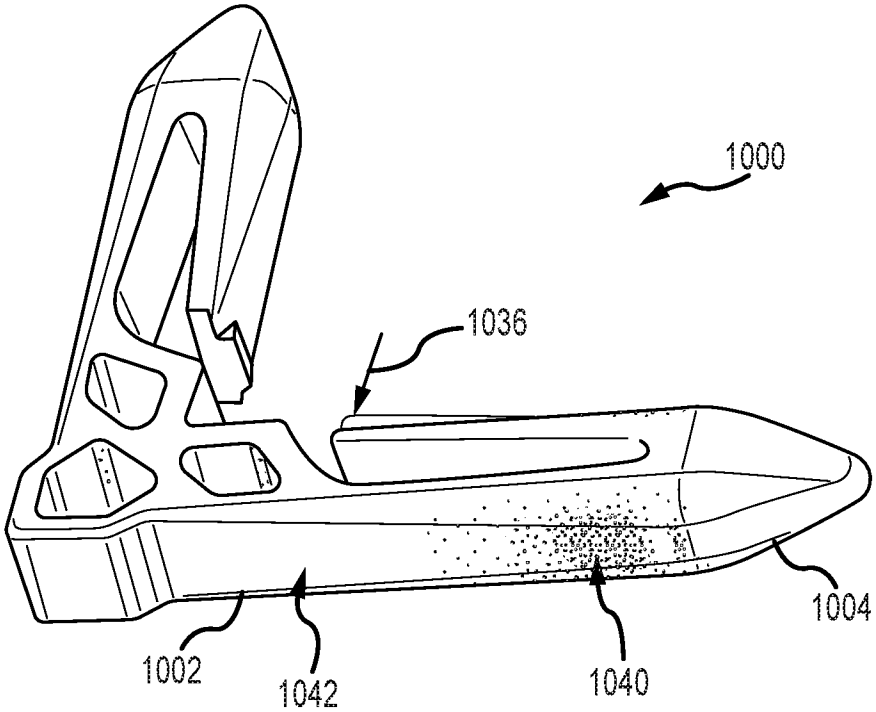

FIGS. 11C and 11D are stress distribution diagrams of the corner key 1000. As described above, when a load 1036 is applied to the barb 1006, the bending stresses 1038 induced on the arm 1008 are distributed along the length of the arm 1008. Additionally, the reduced thickness of the leg 1002 enables the bending stresses 1038 induced on the arm 1008 to be transferred 1040 to an outer surface 1042 of the arm 1008 so as to deflect the nose 1004 and to increase the overall deflection of the barb 1006. By increasing overall deflection of the barb 1006 the retaining force of the corner key 1000 may also be increased. The bending stresses 1040 are positioned adjacent the nose 1004 and opposite the arm 1008. This configuration enables the corner key 1000 to be used for a wide range of frame member sizes and thicknesses without having to extend the length of the leg 1002.

The materials utilized in the corner keys described herein may be those typically utilized for window, window component manufacture, door, and door component manufacture. Material selection for the components may be based on the proposed use of the window or door. For example, the corner keys may be die-cast zinc. Aluminum, steel, stainless steel, plastic or composite materials can also be utilized. The window and door frame members may be extruded plastic, vinyl, or aluminum and contain other hardware therein.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A corner key comprising:

a heel; and at least one leg extending along an axis from the heel, the at least one leg comprising a first surface having a retention element and an opposite second surface having a lifting cam, wherein upon insertion into a frame member, the lifting cam slides along an outer surface of the frame member to induce a bending stress in the retention element against an inner surface of the frame member.

2. The corner key of claim 1, wherein the retention element comprises a cantilevered arm defined in the at least one leg and extending towards the heel along the axis.

3. The corner key of claim 2, wherein the cantilevered arm comprises a free end, and wherein the cantilevered arm tapers towards the free end.

4. The corner key of claim 2, wherein the cantilevered arm comprises a free end and a barb disposed on the free end.

5. The corner key of claim 4, wherein the bending stress is configured to apply a retention force from the barb to the frame member.

6. The corner key of claim 1, wherein the retention element and the lifting cam are offset along the axis.

7. The corner key of claim 1, wherein the at least one leg further comprises a tip, the tip comprising a tapered nose.

8. The corner key of claim 7, wherein the tapered nose is substantially conically-shaped.

9. The corner key of claim 1, wherein the at least one leg is a first leg, the corner key further comprising a second leg extending along a second axis from the heel, the second leg comprising a second retention element and a second lifting cam, wherein upon insertion into a second frame member the second lifting cam induces a second bending stress in the second retention element.

10. The corner key of claim 9, wherein the first leg and the second leg are spaced approximately 90° apart.

11. The corner key of claim 10, wherein an undercut corner is defined in the first surface at the intersection of the first leg and the second leg.

12. The corner key of claim 11, wherein the heel comprises a corner extension opposite the undercut corner.

13. The corner key of claim 9, wherein the first leg is axially longer than the second leg.

14. The corner key of claim 9, wherein the bending stresses are configured to apply at least 35 pounds of retention force from the corner key to the first and second frame members.

15. The corner key of claim 14, wherein the bending stresses are configured to apply at least 50 pounds of retention force from the corner key to the first and second frame members.

16. A corner key comprising:

a heel;

a first leg extending along a first axis from the heel, wherein the first leg comprises a first inner surface defining a first tapered cantilevered arm and an opposite first outer surface defining a first lifting cam; and a second leg extending along a second axis from the heel, wherein the second leg comprises a second inner surface defining a second tapered cantilevered arm and an opposite second outer surface defining a second lifting cam wherein upon insertion into a respective frame member, each respective lifting cam slides along an outer surface of the frame member to induce a bending stress in the respective cantilevered arm against an inner surface of the frame member.

* * * * *